US010858922B2

(12) United States Patent
Hunter et al.

(10) Patent No.: US 10,858,922 B2
(45) Date of Patent: Dec. 8, 2020

(54) SYSTEM AND METHOD OF DELIVERING STIMULATION TREATMENT BY MEANS OF GAS GENERATION

(71) Applicant: Halliburton Energy Services, Inc., Houston, TX (US)

(72) Inventors: Tim H. Hunter, Duncan, OK (US); Stanley V. Stephenson, Duncan, OK (US); Jim Basuki Surjaatmadja, Duncan, OK (US); Bryan John Lewis, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 184 days.

(21) Appl. No.: 16/092,153

(22) PCT Filed: Aug. 19, 2016

(86) PCT No.: PCT/US2016/047832
§ 371 (c)(1),
(2) Date: Oct. 8, 2018

(87) PCT Pub. No.: WO2018/034673
PCT Pub. Date: Feb. 22, 2018

(65) Prior Publication Data
US 2019/0153845 A1 May 23, 2019

(51) Int. Cl.
*E21B 43/263* (2006.01)
*E21B 43/26* (2006.01)
(Continued)

(52) U.S. Cl.
CPC ..... *E21B 43/263* (2013.01); *E21B 36/003* (2013.01); *E21B 43/248* (2013.01); *E21B 43/26* (2013.01)

(58) Field of Classification Search
CPC .. E21B 43/2605; E21B 43/26; E21B 43/1185; E21B 43/247; E21B 43/248; E21B 43/263
See application file for complete search history.

(56) References Cited

U.S. PATENT DOCUMENTS 1,806,499 A 5/1931 Ranney et al.
2,766,828 A 10/1956 Rachford, Jr.
(Continued)

FOREIGN PATENT DOCUMENTS

CA 2791646 A1 * 9/2011 ..... E21B 43/263

OTHER PUBLICATIONS

W.D. Howell and T.J. Clare, Case History—Explosive Fracturing for Well Stimulation, API 70-058, pp. 58-62, 1970.
(Continued)

*Primary Examiner* — Jennifer H Gay
(74) *Attorney, Agent, or Firm* — McAfee & Taft

(57) ABSTRACT

In downhole tools and methods related to stimulation of subterranean formations are provided. The tools and methods utilize electrically ignitable propellant to generate gas downhole that is used to generate or enhance fractures. The electrically ignitable propellant can be ignited applying electrical power to a pair of electrodes associated with the propellant. Subsequently, the ignition can be halted by ceasing to supply the electrical power. Thus, allowing for the control of the amount and location of generated gas.

20 Claims, 7 Drawing Sheets

(51) Int. Cl.
*E21B 43/248* (2006.01)
*E21B 36/00* (2006.01)

(56) References Cited

U.S. PATENT DOCUMENTS 3,254,715 A * 6/1966 Morse ..... E21B 43/24 166/288
3,422,760 A * 1/1969 Mohaupt ..... E21B 43/263 102/313
3,465,818 A 9/1969 Dixon
3,688,843 A 9/1972 Nordyke
3,999,609 A 12/1976 Field
4,248,303 A * 2/1981 Charpentier ..... F42D 1/00 102/313
4,490,196 A 12/1984 Funk
4,530,396 A 7/1985 Mohaupt
4,633,951 A * 1/1987 Hill ..... E21B 43/267 166/297
4,683,943 A * 8/1987 Hill ..... E21B 43/267 166/177.5
4,823,875 A * 4/1989 Hill ..... E21B 43/263 166/280.1
5,005,641 A * 4/1991 Mohaupt ..... E21B 43/263 102/313
5,573,307 A * 11/1996 Wilkinson ..... E21B 7/15 299/14
6,035,784 A 3/2000 Watson
6,289,813 B1 * 9/2001 Duguet ..... C06C 7/00 102/202.14
6,817,298 B1 * 11/2004 Zharkov ..... E21B 43/006 102/288
6,837,310 B2 1/2005 Martin
7,228,907 B2 * 6/2007 Schmidt ..... E21B 43/263 102/309
7,810,569 B2 10/2010 Hill et al.
7,819,180 B2 * 10/2010 Zhou ..... E21B 43/263 102/318
7,861,785 B2 * 1/2011 Frazier ..... E21B 43/11 166/299
7,958,823 B2 6/2011 Sawka
8,464,640 B2 6/2013 Sawka
8,617,327 B1 12/2013 Katzakian et al.
8,857,338 B2 * 10/2014 Sawka ..... F02K 9/95 102/202
8,888,935 B2 11/2014 Grix et al.
9,447,672 B2 * 9/2016 Arrell, Jr. ..... C06B 45/00
9,470,079 B1 * 10/2016 Schmidt ..... E21B 43/263
9,726,000 B2 * 8/2017 Owens ..... E21B 43/26
9,890,628 B2 * 2/2018 Sin ..... E21B 43/263
9,995,124 B2 * 6/2018 Moore ..... E21B 43/263
2003/0155112 A1 * 8/2003 Tiernan ..... F42B 3/02 166/63
2006/0011276 A1 1/2006 Grix et al.
2009/0211746 A1 * 8/2009 Zhou ..... E21B 43/263 166/63
2011/0094745 A1 * 4/2011 Frazier ..... E21B 43/267 166/308.1
2011/0259230 A1 * 10/2011 Sawka ..... F23R 7/00 102/374
2012/0138302 A1 * 6/2012 Stehle ..... E21B 43/116 166/297
2013/0000908 A1 * 1/2013 Walters ..... E21B 43/248 166/299
2014/0238678 A1 * 8/2014 Arrell, Jr. ..... E21B 43/263 166/298
2015/0047526 A1 * 2/2015 Sawka ..... F41A 1/04 102/374
2015/0114623 A1 * 4/2015 Owens ..... E21B 43/26 166/248
2015/0345922 A1 * 12/2015 Lanclos ..... F42B 3/125 166/297
2016/0046536 A1 2/2016 Haug et al.
2016/0084055 A1 * 3/2016 Moore ..... E21B 33/124 166/299
2017/0138163 A1 * 5/2017 Sin ..... E21B 47/06
2019/0153845 A1 * 5/2019 Hunter ..... E21B 43/263
2019/0316455 A1 * 10/2019 Surjaatmadja ..... F42D 1/05
2020/0032601 A1 * 1/2020 Nguyen ..... C06B 31/30
2020/0032633 A1 * 1/2020 Nguyen ..... C06B 25/34
2020/0033101 A1 * 1/2020 Burky ..... F42D 3/00
2020/0040714 A1 * 2/2020 Surjaatmadja ..... E21B 33/138

OTHER PUBLICATIONS

S.J. LaRocca and A.M. Spencer, Chemical Explosive Fracturing of Devonian Shale Gas Wells, UGR 181 EGS, Petroleum Technology Corporation, Jun. 1978.

* cited by examiner

SYSTEM AND METHOD OF DELIVERING STIMULATION TREATMENT BY MEANS OF GAS GENERATION

FIELD

This disclosure relates to methods of servicing a wellbore. More specifically, it relates to servicing a wellbore to generate or enhance fractures in a reservoir surrounding the wellbore.

BACKGROUND

An important area in the recovery of hydrocarbons from subterranean formations is well stimulation methods, which foster additional and economical recovery of valuable fossil fuels from the formations. As employed herein, the term "well stimulation" refers to any method employed to enlarge or create new flow fissures or fractures in a subterranean hydrocarbon-producing formation. Generally speaking, three broad categories of well stimulation techniques are known, each of which bears certain disadvantages.

Hydraulic fracturing represents one of these categories and is presently widely practiced. Hydraulic fracturing involves injecting a liquid into the wellbore under relatively enormous pressure, thereby to cause splitting and fracturing of the relatively "tight" pay formation. This method finds particular use with respect to formations, which are not normally sufficiently amenable to stimulation by means of acidification techniques. While the principal purpose of the liquid employed in hydraulic fracturing is to act as a pressure transfer agent and to thereby transmit the pressure generated at the surface of the well site to the downhole formation, the liquid is also often additionally employed as a carrier for sand or other particulate solids. The liquid conveys these solids into the fissures caused by the hydraulic fracturing and thereafter serve to stabilize the fractured formation and to ensure maintenance of the freshly opened fissures. Typical hydraulic liquids comprise refined oil, crude oil, salt water, acids, emulsifiers and other additives. Acids in fracturing processes maintain the opening of fissures by etching the surfaces unevenly, thus creating large channels when the fissures close. While well stimulation by hydraulic fracturing has been successful, it can be expensive because of the various and complex equipment required to generate the relatively enormous downhole hydraulic pressures, which may exceed 10,000 p.s.i. In addition, hydraulic fracturing can be a relatively lengthy process to undertake.

Another broad category of well stimulation technique resides in acid treatment of susceptible pay formations. Depending upon the nature and composition of the formation, one or more acids are pumped downhole to the formation and, upon contact therewith, cause channeling and fissuring by chemical reaction. Acid treatment well stimulation techniques find fairly extensive use with respect to pay formations composed of limestone or dolomite which, as a result of their composition, are especially susceptible to hydrochloric acid attack. Various other acids and acid treating formulations can be employed. For instance, hydrofluoric acid and mixtures thereof with hydrochloric acid are often employed when the producing formation to be stimulated comprises clay or sandstone or wherein a portion of the overall stimulation process is directed to the removal of mud from the pore space about the well. Rheological acid compositions are also employed and are generally introduced into the well as a liquid. At the formation site, however, a rheological acid composition tends to set up as a viscous mass, thereby to retard its chemical action until such time as it has found its way back into the tight formation. Well stimulation by acid treatment generally requires the removal of spent acid from the formation. This, of course, can require that the spent acid be swabbed or pumped out of the well and that suitable provisions be made for the disposal thereof. Further, should the acid treating agent be left downhole, it can substantially reduce the service life of the pump and other equipment associated with the well.

The third general category of well stimulation technique known in the art is known broadly as explosive fracturing. Typically, explosive fracturing involves placing an explosive charge downhole and detonating it so as to shatter the tight pay formation and thereby permit the oil or other fossil fuel of interest to flow through the rubble to the well. Historically, the first methods of explosive fracturing involved the use of pure nitroglycerin which, of course, can be an extremely dangerous and sensitive explosive. This problem has been mollified somewhat by the advent of safer explosives which are generally lowered into the well in combination with timed detonators. More recent developments with respect to explosive fracturing techniques involve the use of explosive liquids which are pumped into the pores of the pay formation and are thereafter detonated. Unfortunately, such liquid explosives often can be of a critical compositional nature and overly sensitive to shock, static electricity, heat and the like. Atomic explosives have been experimentally employed in fracturing wells and some successes have been had in creating massive fracturing of tight pay formations by this technique in gas wells located in New Mexico and Colorado. Obviously, however, the use of atomic or thermonuclear charges is, as yet, extremely expensive for this purpose and additional safety problems are incurred with respect to proper and safe disposition of radioactive wastes Finally, the use of explosive fracturing techniques of the prior art in attempting to stimulate a well can often result in substantial downhole cave-ins of the well, thereby choking it with debris, Thus, when explosively fracturing a well in accordance with prior art practices, it is often necessary to remove debris by such ancillary techniques as sand bailing or back flushing of the wellbore with a pumped carrier liquid.

BRIEF DESCRIPTION OF THE DRAWINGS

FIG. 6 is a schematic view of the downhole tool utilized with an embodiment where a proppant containing fluid is introduced into the fractures generated by the downhole tool.

DETAILED DESCRIPTION

Figures 1A, 1B, 1C:
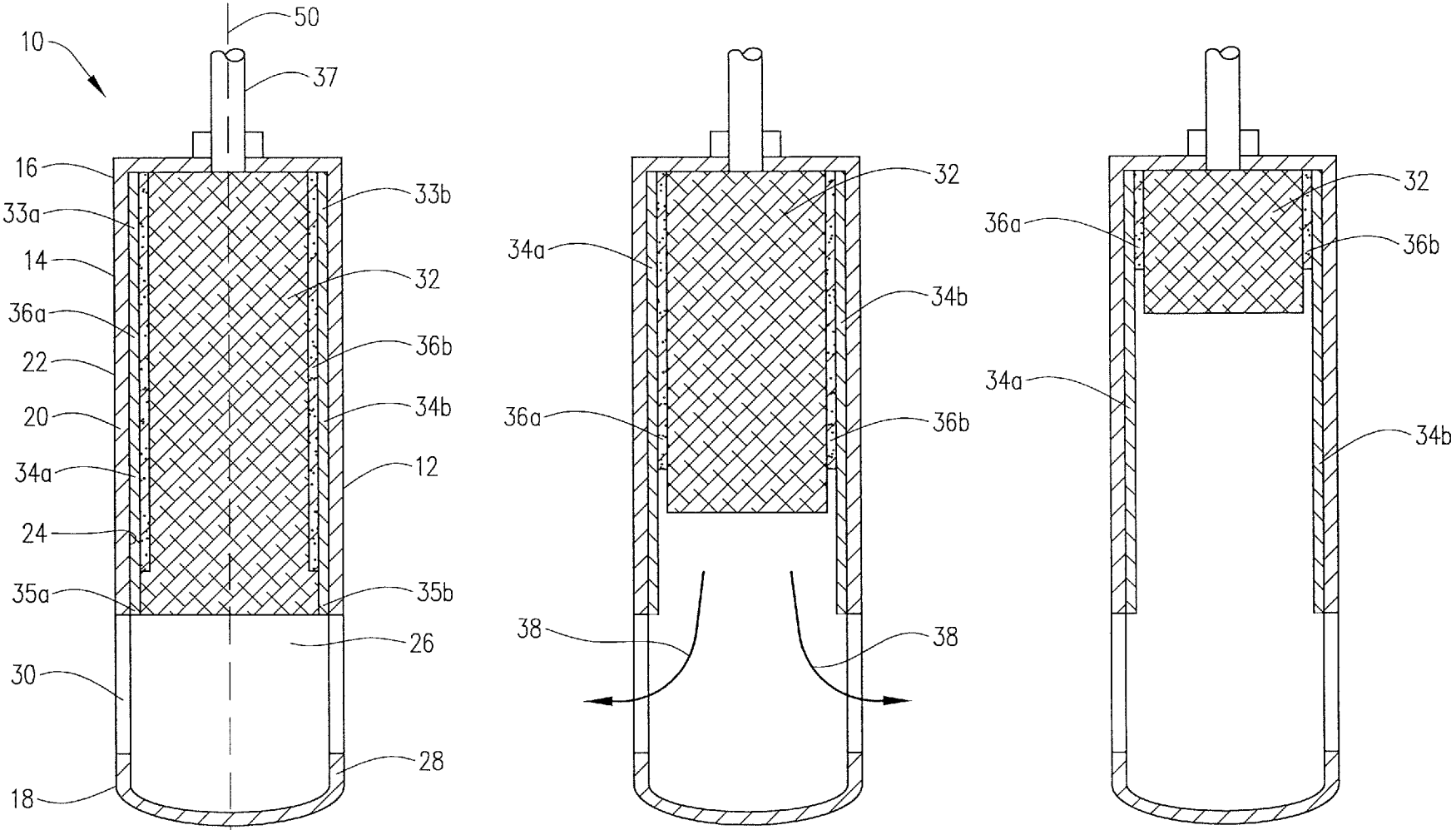
FIG. 1A is a cross-sectional view of a downhole tool for the explosive generation of gas in accordance with one embodiment.
FIG. 1B is a cross-sectional view of the downhole tool FIG. 1A after a first portion of the propellant has been ignited.
FIG. 1C is a cross-sectional view of the downhole tool FIG. 1A after a second portion of the propellant has been ignited.

The present disclosure may be understood more readily by reference to the following detailed description as well as to the examples included therein. In addition, numerous specific details are set forth in order to provide a thorough understanding of the embodiments described herein. However, those of ordinary skill in the art will understand that the embodiments described herein can be practiced without these specific details. In other instances, methods, procedures and components have not been described in detail so as not to obscure the related relevant feature being described. Additionally, the description is not to be considered as limiting the scope of the embodiments described herein.

Referring now to the drawings, wherein like reference numbers are used herein to designate like elements throughout the various views, various embodiments are illustrated and described. The figures are not necessarily drawn to scale, and in some instances the drawings have been exaggerated and/or simplified in places for illustrative purposes only. In the following description, the terms "upper," "upward," "lower," "below," "downhole" and the like, as used herein, shall mean: in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well-known designs are employed, their structure and operation will not be described in detail. One of ordinary skill in the art will appreciate the many possible applications and variations of the present invention based on the following description.

Turning now to FIGS. 1A, 1B and 1C, a downhole tool 10 for stimulating a hydrocarbon-producing formation in accordance with one embodiment is illustrated. Downhole tool 10 has detonation section 12 for generating a gas, which can be used in stimulating a hydrocarbon-producing subterranean formation. Detonation section 12 comprises a housing 14 having a first end 16, a second end 18 and a wall 20 extending from first end 16 to second end 18. Wall 20 has an outer surface 22 and an inner surface 24. During operation of the downhole tool, outer surface 22 is exposed to a well annulus between a wellbore wall and downhole tool 10. Inner surface 24 defines a central bore 26 extending from first end 16 to second end 18. Central bore 26 terminates in a nozzle section 28 at or proximate to second end 18. Nozzle section 28 has apertures 30, which channel and direct fluids, typically gas from central bore 26 out into the well annulus so as to impact the subterranean formation, as further described below.

Central bore 26 contains a volume of electrically ignitable propellant 32 and a pair of electrodes 34*a* and 34*b*. Electrically ignitable propellant 32 is ignitable in response to the application of electrical power therethrough. Pair of electrodes 34*a* and 34*b* are operable to ignite the propellant via application of electrical powered therethrough via wireline 37. Each of the electrodes 34*a* and 34*b* has a first edge 33*a* and 33*b* proximate to first end 16 of housing 14 and operatively connected to wireline 37 so as to conduct electrical energy transmitted downhole by wireline 37. Each electrode 34*a* and 34*b* has a second edge 35*a* and 35*b* proximate to nozzle 28. Wireline 37 is attached to downhole tool 10 and extends up the wellbore to the surface where it is operatively attached to equipment so as to provide electrical power to downhole tool 10 and so as to move downhole tool 10 up or down the wellbore.

Electrodes 34*a* and 34*b* can be electrode rods or wires but often will be flat plate electrodes, which may allow more uniform electrical current density therebetween and more efficient combustion of the propellant 32. The material of electrodes 34*a* and 34*b* may be of a suitable material, such as aluminum, to be consumed during combustion of propellant 32. In other embodiments, electrodes 34*a* and 34*b* may be made of stainless steel or the like so as not to be consumed by the combustion.

In the embodiment illustrated in FIGS. 1A, 1B and 1C, detonation section 12 further comprises an insulation layer 36*a* and 36*b* disposed on each electrode 34*a*, 34*b*. Insulation layer is disposed so as to extend from first edge 33*a* and 33*b* towards second edge 35*a*, 35*b* but not extending to the second edge so that a portion of electrode 34*a* and 34*b* at second edge 35*a* and 35*b* remains bare and contacts the propellant. Insulation layer 36*a* and 36*b* may be made of a suitable material so as to combusted with propellant 32. For example, insulation layer 36*a* and 36*b* can be made from polytetrafluoroethylene (PTFE) coatings, such as Teflon™ PTFE, or phenol formaldehyde resin coatings, also known as phenolic coatings.

FIGS. 1A, 1B and 1C illustrate an exemplary combustion process of a portion of propellant 32. As seen in FIG. 1A, insulation layer 36*a*, 36*b* do not extend to second edge 35*a*, 35*b* of electrode 34*a* and 34*b* such that a portion of propellant 32 contacts opposing electrodes 34*a* and 34*b*. Electrodes 34*a* and 34*b* may be energized to initiate combustion in this region. When the electrodes 34*a* and 34*b* are energized, propellant 32 and insulation layer 36*a* and 36*b* combust (heat and gas exiting downward towards nozzle section 28 as shown by arrows 38). Insulation layer 36*a* and 36*b* burns away in front of the flame front, thereby sustaining a contact between electrodes 34*a* and 34*b* and propellant 32. The power supplied to electrodes 34*a* and 34*b* may be stopped, as shown in FIG. 1B, and combustion ceased. The power supplied to electrodes 34*a* and 34*b* may be initiated again, and propellant 32 and insulation layer 36*a* and 36*b* combust again. The power supplied to electrodes 34*a* and 34*b* may be stopped, as shown in FIG. 1C, and combustion ceased. Insulation layer 36*a* and 36*b* burns away in front of the flame front or combustion of propellant 32 such that when combustion is ceased electrodes 34*a* and 34*b* are still in contact with propellant 32 and may be reinitiated by providing power to electrodes 34*a* and 34*b*. In this manner, the amount of combustion can be controlled. That is, sustained electrical pulses can be used to provide a sustained combustion and therefore continuous gas generation during the sustained combustion. More typically, short electrical pulses will be provided resulting in smaller explosions than results from the longer sustained electrical pulses. Thus, electrical pulses of microsecond or millisecond duration can be used to generate microsecond or millisecond duration combustions and the associated gas generation. Such short electrical pulses, allow for relocation of the downhole tool such that different sections of the formation can be fractured, as further described below. Additionally or alternatively, short electrical pulses can allow the gas generated by the combustion to result in gas pulses that follow the natural beat frequency of the fracture, as further described below. Generally, the short duration pulses will be less than about 0.01 second duration, and more typically from about 0.000001 to about 0.01 second duration, from about 0.000002 to about 0.009 second in duration, or from about 0.000005 to about 0.005 second duration.

Typically, nozzle section 28 is configured to direct combustion in a direction transverse to longitudinal axis 50 of downhole tool 10. Thus, gas generated by the ignition of propellant 32 flows toward nozzle section 28 where it is directed from mainly a longitudinal direction to the traverse direction and out of apertures 30 such that the gas interacts with the formation to generate or enhance fractures in the subterranean formation. As illustrated in FIGS. 1B and 1C, a small gap is shown between electrode 34*a* and 34*b* and propellant 32 where insulation layer 36*a* and 36*b* has burned away. Insulation layer 36*a* and 36*b* is relatively thin such that any resulting gap does not significantly impede the flow of electricity between electrode 34*a* and 34*b* and propellant 32.

Figure 2:
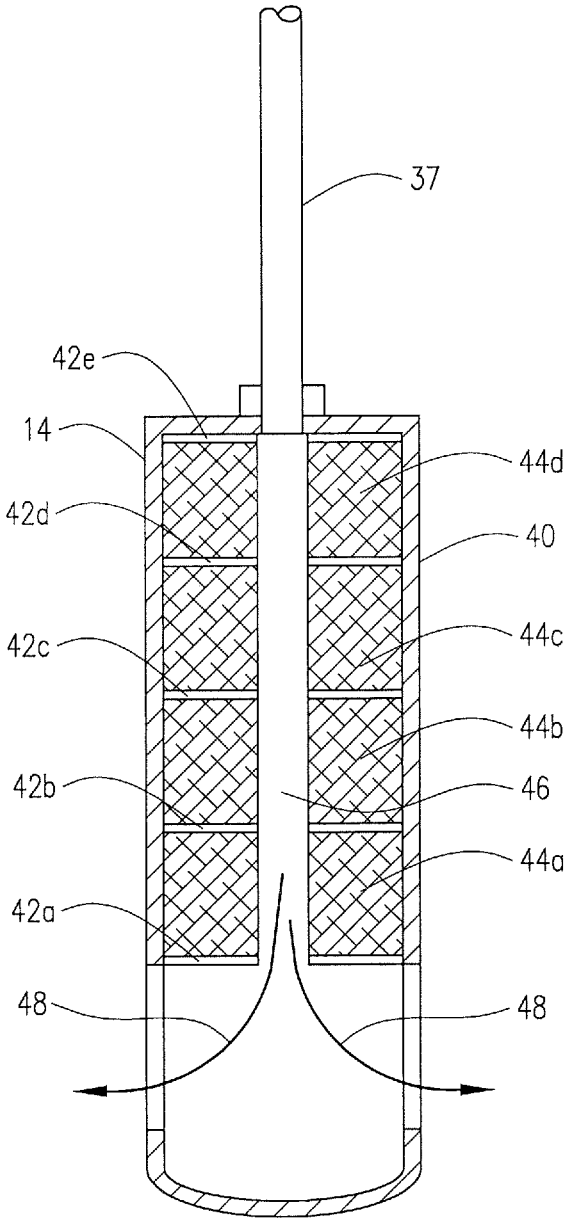
FIG. 2 is a cross-sectional view of a downhole tool for the explosive generation of gas in accordance with a second embodiment.

According to another aspect illustrated in FIG. 2, multiple structures for igniting electrically ignitable propellant may be combined or stacked to form a detonation section. Such structures allow for sequential ignition of the sections. FIG. 2 illustrates an exemplary configuration of forming a detonation section 40 utilizing stacked structures, which may be used in a downhole tool. Detonation section has a housing 14 as described above for FIG. 1A. It has a series of electrodes 42*a*, 42*b*, 42*c*, 42*d* and 42*e* operably connected to wireline 37 so that they may be energized by electrical power via wireline 37. Electrodes 42*a*, 42*b*, 42*c*, 42*d*, and 42*e* are in the form of electrode disc with a center aperture. Sandwiched between electrode discs 42*a*, 42*b*, 42*c*, 42*d* and 42*e* are propellant sections 44*a*, 44*b*, 44*c* and 44*d*, which are also in disc shape with a center aperture. The center apertures of the electrode disc and propellant sections form a common central core 46.

Detonation Section 40 allows for individual control of the four propellant sections 44*a*, 44*b*, 44*c* and 44*d*. Thus, electrode discs 42*a* and 42*b* may be energized by electrical power via wireline 37 to initiate and sustain combustion in propellant section 44*a*. In some embodiments, combustion of propellant section 44*a* will continue only as long as electrode discs 42*a* and 42*b* are energized. In other embodiments, the combustion of propellant section 44*a* will be self-sustaining and continue until the propellant in section 44*a* is consumed whether or not electrode discs 42*a* and 42*b* are continuously energized. After combustion of the propellant in section 44*a*, the downhole tool can be relocated if desired.

Subsequent to the combustion of propellant section 44*a*, electrode discs 42*b* and 42*c* can be energized to initiate combustion in propellant section 44*b*. The process can continue in this manner until the propellant in all four propellant sections 44*a*, 44*b*, 44*c* and 44*d* have been consumed. During combustion of propellant sections 44*a*, 44*b*, 44*c* and 44*d*, gas generated during combustion is channeled down common central core 46 to nozzle section 28 and out apertures 30 as indicated by arrows 48.

Other arrangements of the propellant in the combustion sections will become apparent to those skilled in the art based on the disclosure herein. Generally, sections of propellant may be in direct contact with one another or separated by conductive electrodes or insulating layers as shown and described. Further, the electrodes may include conductive materials such as copper, aluminum, stainless steel, zirconium, gold, and the like. Insulator materials for the dies, casing, electrodes or to separate propellant sections may include rubber, phenolic, Teflon®, ceramic, and the like. The electrode geometries may be configured to allow specific volumes or surfaces of propellant to be ignited individually and/or in combination to achieve desired gas generation control. Electrode geometry and/or conductive surface coatings can control propellant combustion either proceeding inward from surfaces or to instantaneously ignite specific volumes. Electrode surfaces may be varied from smooth to porous mesh changing the surface area in contact with the propellant.

The exemplary methods and structures described use an electrically ignitable propellant or explosive, such as described in U.S. patent application Ser. Nos. 10/136,786 and 10/423,072; and U.S. Pat. Nos. 8,617,327 and 8,888,935. These electrically ignitable propellants can be ignited and controlled at least in part by the application of electrical power in an electrical circuit. That is, passing electrical current through the propellant causes ignition/combustion to occur, thereby obviating the need for pyrotechnic ignition of the propellant. Preferred electrically ignitable propellants are ones that can be ignited by applying electrical voltage and can be extinguished by withdrawing electrical voltage. In many embodiments, the electrically ignitable propellant's ignition, combustion and combustion rate depend on the flow of a suitable amount of electrical current through the propellant and the propellant immediately ceases combustion when the voltage is removed or lowered below the threshold level for combustions. That is, the combustion ceases upon removal or lowering of the voltage such that a substantial amount of propellant is not consumed after removal or lowering of the voltage. In some embodiments, propellants that begin and cease combustion rapidly so that combustion durations of microsecond or millisecond duration are preferred.

Suitable electrically ignitable propellants can include an ionomer oxidizer polymer binder, an oxidizer mix including at least one oxidizer salt and at least one eutectic material. For example, the ionomer oxidizer polymer binder can be polyvinylammonium nitrate; the oxidizer salt can be ammonium nitrate; and the eutectic additive may comprise a variety of salts or mixtures thereof, and preferably comprises an energetic material such as ethanolamine nitrate, ethylene diamine dinitrate, or other alkylamine or alkoxylamine nitrate, or various mixtures or admixtures thereof.

Other suitable propellants can be made by first creating a mixture of a heat-treated copolymer of polyvinylalcohol (PVA)/polyvinylamine (PVAN) binder, a hydroxylamine nitrate based oxidizer, a 5-aminotetrazole stabilizer, and a dipyridyl complexing agent. Boric acid as a crosslinking agent can be dissolved in the mixture to thus crosslink the heat-treated PVA/PVAN copolymer. After which, the mixture can be cooled and then cured by heat treatment.

Figure 3:
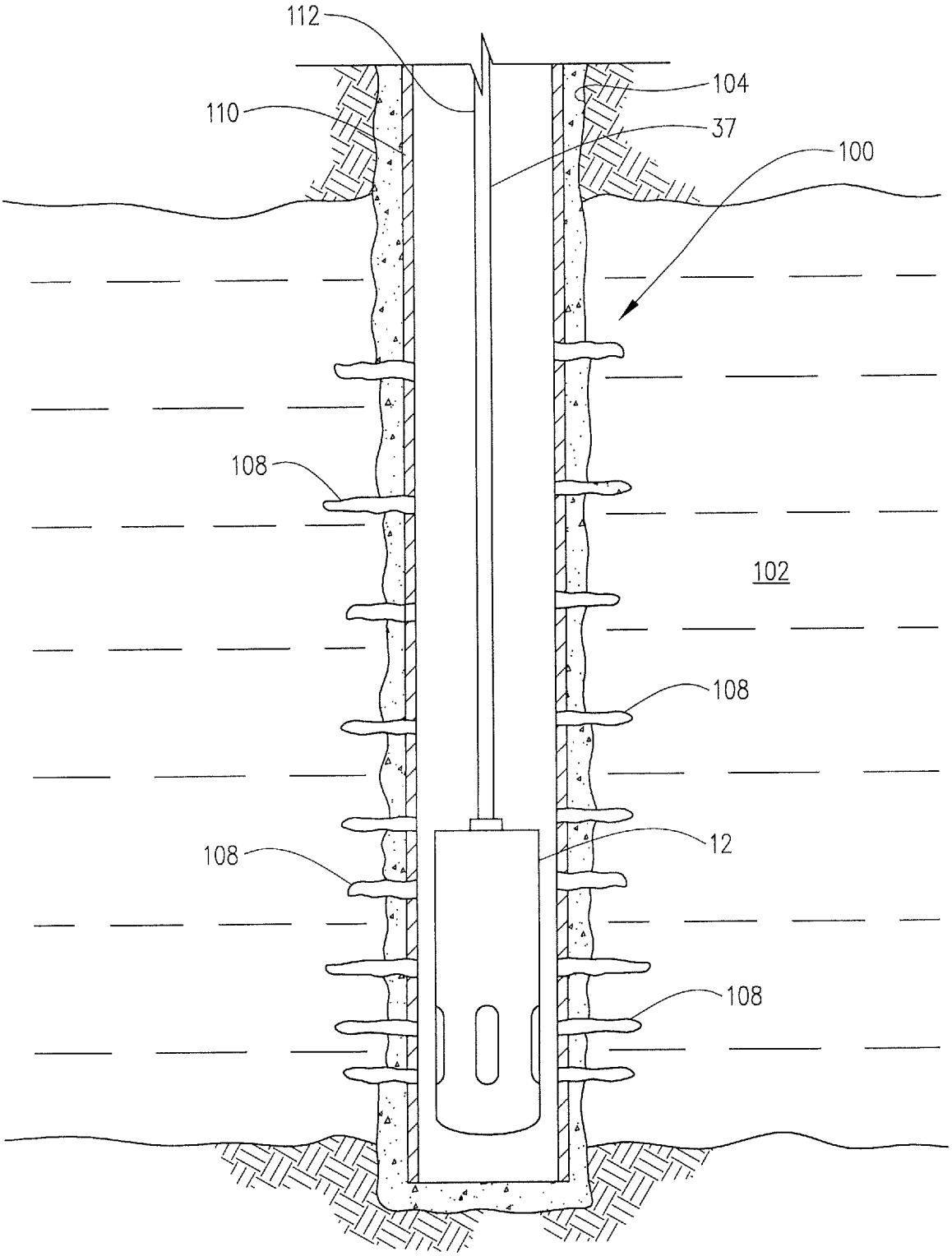
FIG. 3 is a schematic view of a downhole tool positioned in a wellbore. The downhole tool is a gas-generating tool in accordance with one embodiment.

FIG. 3 shows the well 100 during a fracturing operation in a portion of a subterranean formation of interest 102 surrounding a wellbore 104. The wellbore 104 extends from the surface. Although shown as vertical, the wellbore 104 may include horizontal, vertical, slant, curved, and other types of wellbore geometries and orientations, and the fracturing treatment may be applied to a subterranean zone surrounding any portion of the wellbore. The wellbore 104 can include a casing 110 that is cemented or otherwise secured to the wellbore wall. The wellbore 104 can be uncased or include uncased sections. Perforations 108 can be formed in the casing 110 to allow gas generated during the fracturing operation to access the formation. In cased wells, perforations can be formed using shape charges, a perforating gun, hydro jetting and/or other tools. In uncased wellbores, perforations 108 can be omitted.

The well 100 is shown with a work string 112 depending from the surface into the wellbore 104. The work string 112 may include wireline 37 and detonation section 12. The work string 112 can further include packers that seal the annulus between the work string 112 and the wellbore 104. Alternatively or additionally, the work string 112 can include other flow control devices, bypass valves, ports, and or other tools or well devices that control a flow of fluids through the casing.

In operation, detonation section 12 is introduced into wellbore 104 by wireline 37 so that detonation section 12 is proximate to a first portion of the formation 102. Once in position, electrical power is applied to a pair of electrodes in detonation section 12 through wireline 37, which ignites a volume of electrically ignitable propellant in detonation section 12. The ignition of the volume of electrically ignitable propellant generates gas at a relatively high pressure in addition to the concussion of the detonation. Generally, detonation section 12 can be configured to direct the gas in a direction transverse to the longitudinal axis of the downhole tool such that the gas interacts with the formation to generate or enhance fractures 114 in the formation (See FIG. 4). Thus, the gas is directed towards the first portion of the formation through perforations 108 so as to generate or enhance fractures 114 in the first portion of the formation thus stimulating the production of hydrocarbons from the formation. Well 100 can be seen immediately after the generation and enhancement of fracture in FIG. 4.

Figure 4:
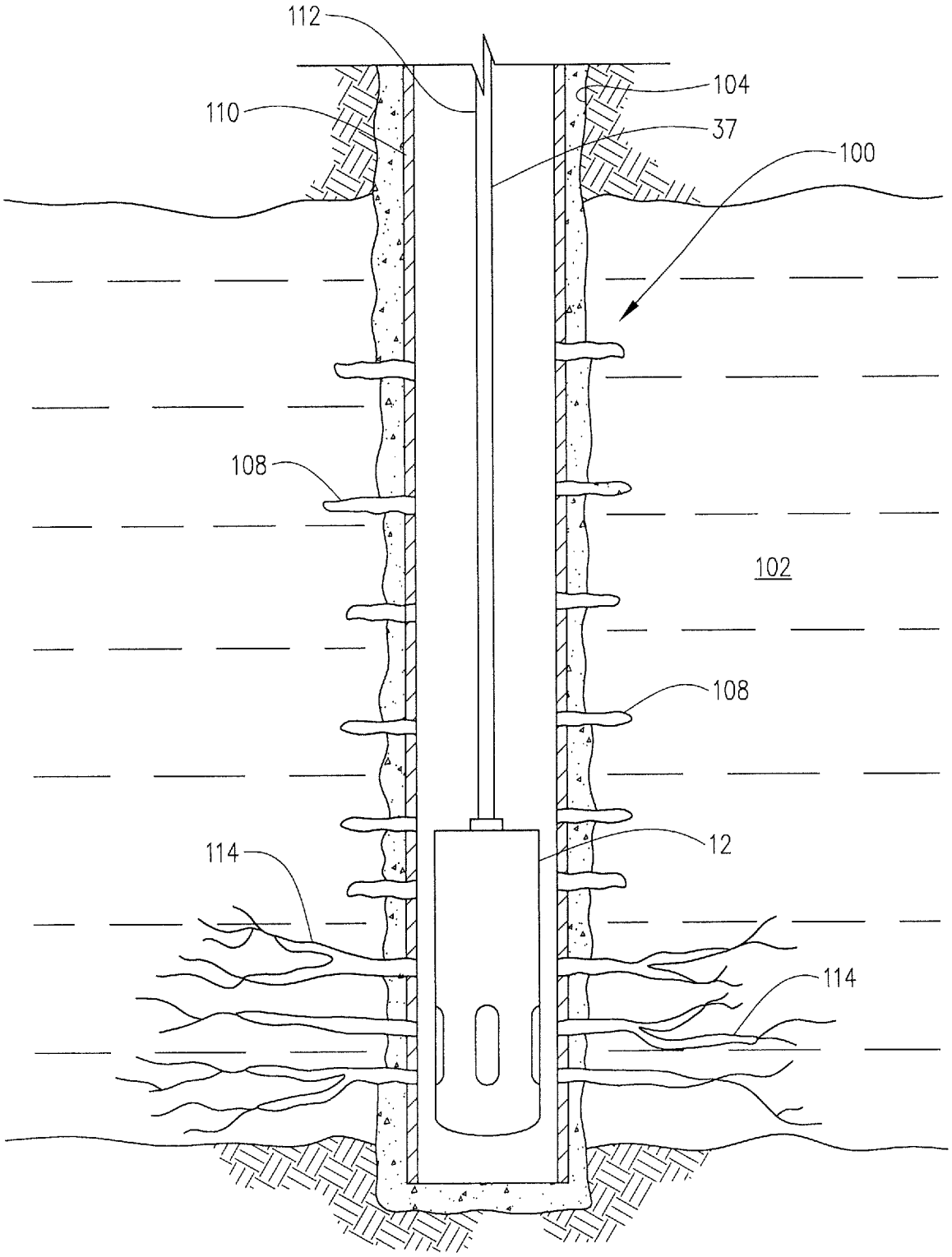
FIG. 4 is a schematic view of the downhole tool of FIG. 1 after the gas has been generated and used to create or enhance fractures in a surrounding subterranean formation.

In a slightly different implementation, the well 100, specifically inside the casing 110 in the annulus, can be pressurized from the surface to a pressure that is slightly below the required fracturing pressure level of this reservoir. The detonation of the explosives will create a high pressure pulse to the perforation nearby, causing fracture(s) 114 to be created near the tool as shown in FIG. 4. At this instant, the surface pressure in the annulus can be slightly increased to help extend the size or length of fractures 114. Sometimes, such extension may cease, and may probably require the increase of annular pressure from the surface. Doing this, however, may prematurely initiate fractures in the formation above it. To avoid this from happening, or in other unrelated situations, the explosive device 12 may be triggered multiple times so that the pulses follow the natural frequency of the fracture. The natural frequency of the fracture is defined by the equation:

$$F=c/(2\cdot FL)$$

where F is frequency, c is the speed of sound in the fluid in the well and FL is the fracture half length. The natural frequency is more fully described in U.S. Pat. No. 7,100,688 and SPE 77598. As this frequency relates inversely to the fracture length, the pulses should happen very fast at the beginning, and slow down quickly as the fracture extends.

Figure 5:
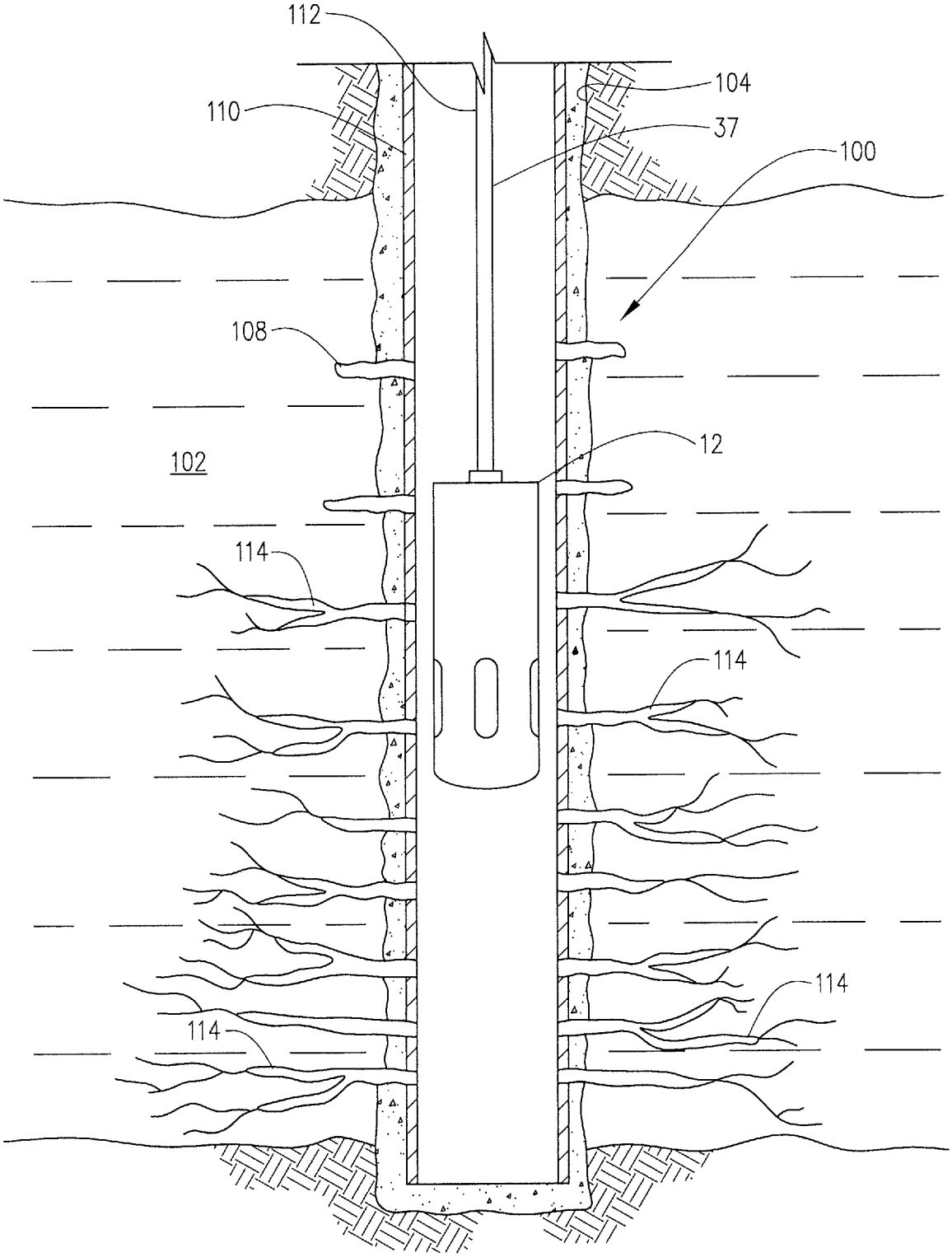
FIG. 5 is a schematic view of the downhole tool of FIG. 1 illustrating its movement to different portions of the wellbore.
Figure 5:
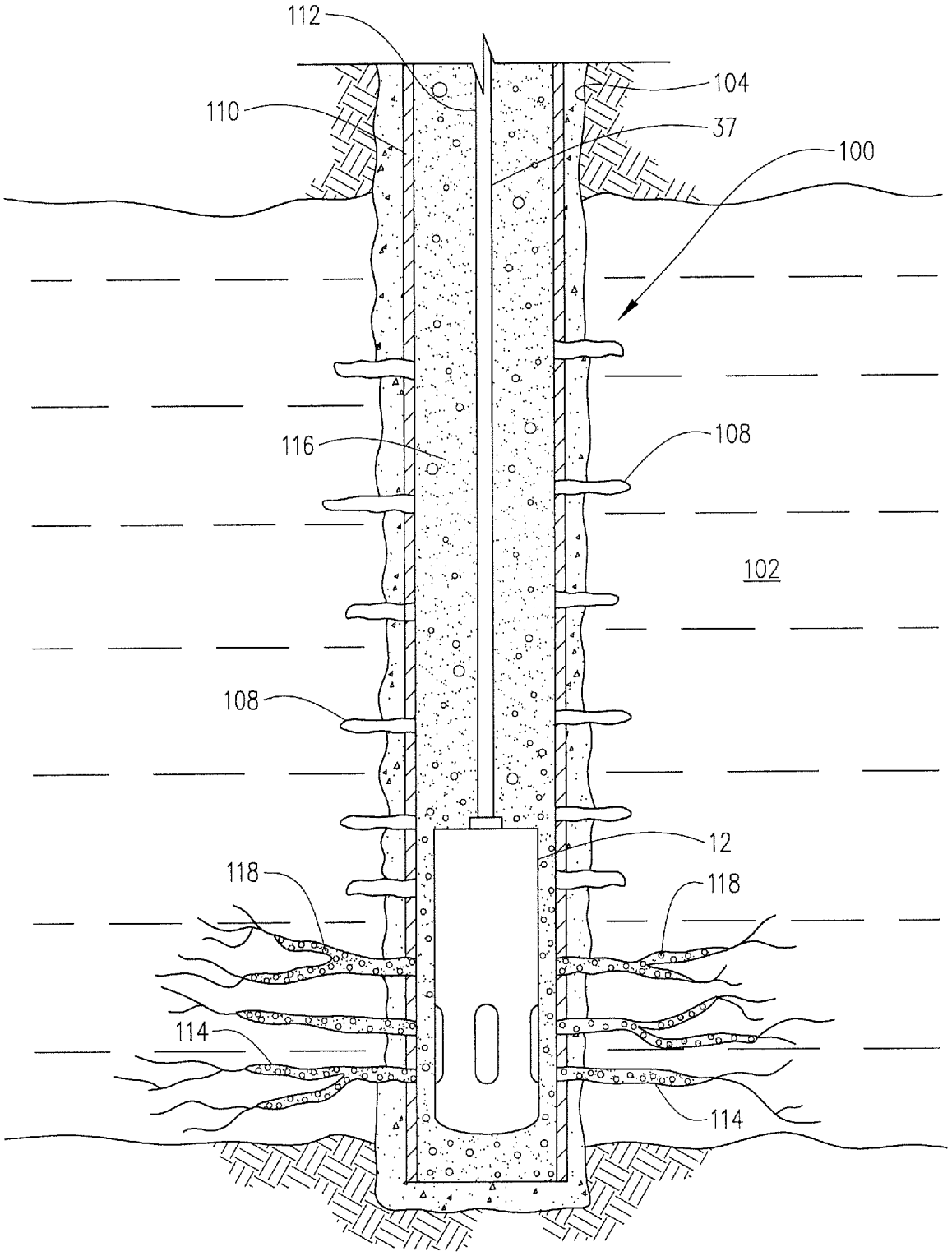

As illustrated in FIGS. 3, 4 and 5, in some embodiments, detonation section 12 is moved upwards in wellbore 104 so as to generate fractures in different portions of formation 102. In some of these embodiments, the movement can be continuous such that detonation section 12 is continually moved upwards in wellbore 104 during ignition of the volume of electrically ignitable propellant. Thus, detonation section 12 is rapidly pulsed to create pulsed gas as it moves upwards in wellbore 104 to create or enhance fractures as it moves past different portions of formation 102.

In other of these embodiments, after generation or enhancement of fractures in the first portion of formation 102, application of electrical power to the pair of electrodes is ceased so as to stop the ignition of the volume of electrically ignitable propellant. Next, detonation section 12 is relocated to be proximate to a second portion of formation 102. Once relocated, electrical power is once again applied to the pair of electrodes to thus re-ignite the volume of electrically ignitable propellant in the detonation section and generate the gas. The generated gas is directed to the second portion of formation 102 so as to generate or enhance fractures in the second portion of the formation thus stimulating the production of hydrocarbons from formation 102. Embodiments with discontinuous ignition of the electrically ignitable propellant can be useful where the annulus must be sealed, such as by the use of packers, to retain adequate pressure at the portion of the formation being stimulated. That is, a first portion of the wellbore adjacent to the first portion of the formation can be isolated to prevent fluid flow up or down the wellbore from the first portion. Next, the propellant can be ignited to stimulate the first portion of the formation. After such stimulation has occurred, the packers can be released to unseal the wellbore, the packers and detonation section relocated to a second portion of the wellbore. At the second portion, the packers are resealed and then re-ignition of the propellant can occur for further stimulation of the formation.

Turning now to FIG. 6, to create larger fractures, a portion of the wellbore can be sealed as described above and, after or during ignition of the propellant and directing the gas to a portion of the formation, a proppant-containing fluid 116 can be pumped to the portion of the formation such that the proppant 118 is introduced into fractures 114. In FIG. 6, packers and other sealing means have not been shown for convenience. When the proppant-containing fluid 116 is introduced into wellbore 104 at a sufficient hydraulic pressure to maintain the fracture open during introduction of the proppant, generally the pressure will be at or about at the fracture gradient of the well. Proppant particulates 118 in the fracturing fluid 116 may enter the fractures 114 where they may remain after the remaining portion of the fluid flows out of the wellbore. These proppant particulates may "prop" fractures 114 such that fluids may flow more freely through the fractures 114. After introduction of sufficient proppant into the fractures, the pressure in the wellbore can be reduced so that fluids flow out of the portion being stimulated.

Figure 7:
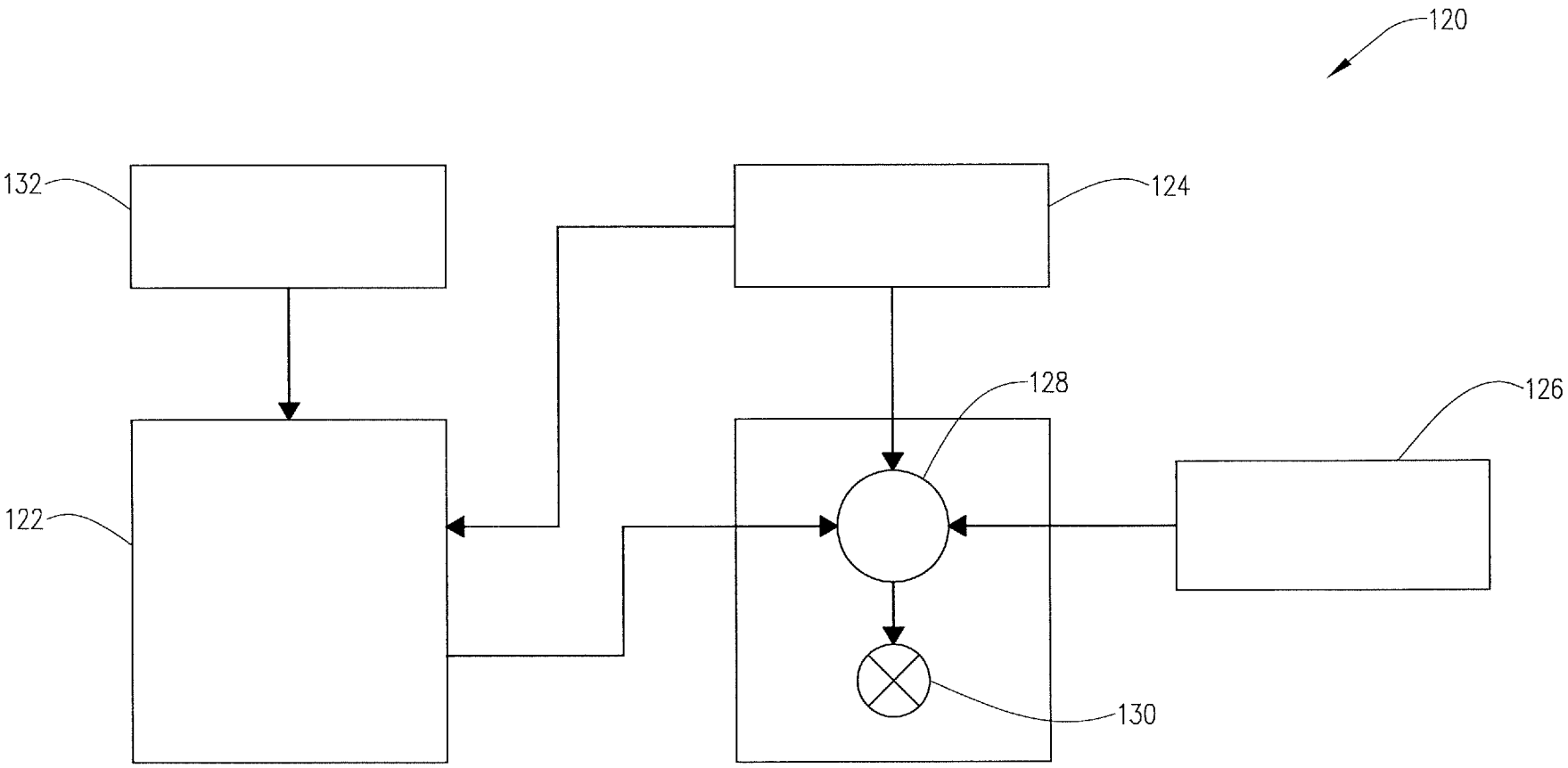
FIG. 7 is a diagram illustrating an example of a proppant fluid system that may be used in accordance with certain embodiments of the present disclosure.

The exemplary methods and compositions disclosed herein may directly or indirectly affect one or more components or pieces of equipment associated with the preparation, delivery, recapture, recycling, reuse, and/or disposal of the disclosed compositions. For example, and with reference to FIG. 7, the disclosed methods and compositions may directly or indirectly affect one or more components or pieces of equipment associated with an exemplary fluid system 120, according to one or more embodiments. In certain instances, the system 120 includes a treatment fluid producing apparatus 122, a fluid source 124, a proppant source 126, and a pump and blender system 128 and resides at the surface at a well site where a well 130 is located. In certain instances, the treatment fluid producing apparatus 122 combines a gel pre-cursor with fluid (e.g., liquid or substantially liquid) from fluid source 124, to produce a hydrated fracturing fluid that is used to introduce proppant to the formation. The hydrated treatment fluid can be a fluid for ready use in a stimulation treatment of the well 130 or a concentrate to which additional fluid is added prior to use in stimulation of the well 130. In other instances, the treatment fluid producing apparatus 122 can be omitted and the treatment fluid sourced directly from the fluid source 124. In certain instances, the treatment fluid may comprise water, a hydrocarbon fluid, a polymer gel, foam, air, wet gases and/or other fluids.

The proppant source 126 can include a proppant for combination with the treatment fluid. The system may also include additive source 132 that provides one or more additives (e.g., gelling agents, weighting agents, and/or other optional additives) to alter the properties of the treatment fluid. For example, the other additives 132 can be included to reduce pumping friction, to reduce or eliminate the fluid's reaction to the geological formation in which the well is formed, to operate as surfactants, and/or to serve other functions.

The pump and blender system 128 receives the treatment fluid and combines it with other components, including proppant from the proppant source 126 and/or additional fluid from the additives 132. The resulting mixture may be pumped down the well 130 under a pressure near the fracture gradient of the well. Notably, in certain instances, the treatment fluid producing apparatus 122, fluid source 124, and/or proppant source 126 may be equipped with one or more metering devices (not shown) to control the flow of fluids, proppants, and/or other compositions to the pumping and blender system 128. Such metering devices may permit the pumping and blender system 128 to source from one, some or all of the different sources at a given time, and may facilitate the preparation of treatment fluids in accordance with the present disclosure using continuous mixing or "on-the-fly" methods. Thus, for example, the pumping and blender system 128 can provide just treatment fluid into the well at some times, just proppants at other times, and combinations of those components at yet other times.

Several alternative embodiments will now be set forth to further define the invention. One group of embodiments includes a downhole tool for stimulating a hydrocarbon-producing formation. The downhole tool has a detonation section for stimulating a hydrocarbon-producing formation. The detonation section comprises a volume of electrically ignitable propellant and a pair of electrodes. The electrically ignitable propellant is ignitable in response to the application of electrical power there through. The pair of electrodes operable to ignite the propellant via application of electrical powered there through.

In these embodiments of the downhole tool, ignition of the propellant can generate a gas and the detonation section configured to direct the gas in a direction transverse to the longitudinal axis of the downhole tool such that the gas interacts with the formation to generate or enhance fractures in the formation. The detonation section can further comprise a nozzle, which directs the gas in the direction transverse to the longitudinal axis.

In some of these embodiments, the detonation section further comprises a housing having a first end, a second end, and a wall. The wall can have an outer surface and an inner surface. During operation of the downhole tool, the outer surface is exposed to a well annulus between a wellbore wall and the downhole tool. The inner surface defines a central bore extending from the first end to the second end. The central bore contains the propellant and the pair of electrodes. When a nozzle is used in such embodiments, it can be located proximate to the second end.

In some embodiments, the detonation section can further comprise an insulation layer disposed on at least one of the electrodes and operable to combust with the propellant. Each of the electrodes can have a first edge proximate to the first end of the housing and a second edge proximate to the nozzle. The insulation layer can be disposed so as to extend from the first edge towards the second edge of at least one of the electrodes but not extending to the second edge so that a portion of the propellant contacts the second edge of each electrode.

Another group of embodiments includes a method of stimulating a hydrocarbon-producing formation. The method comprises the steps of:

- introducing a downhole tool having a detonation section into a wellbore so that the detonation section is proximate to a first portion of the formation;
- applying electrical power to a pair of electrodes;
- igniting a volume of electrically-ignitable propellant in the detonation section in response to the application of electrical power to the pair of electrodes, wherein the ignition of the volume of electrically-ignitable propellant generates a gas; and
- directing the gas to the first portion of the formation so as to generate or enhance fractures in the first portion of the formation thus stimulating the production of hydrocarbons from the formation.

In embodiments of the method, the downhole tool has a longitudinal axis and the detonation section can include a nozzle, which directs the gas in a direction transverse to the longitudinal axis such that the gas interacts with the formation to generate or enhance fractures in the formation.

The method can further comprise contacting the volume of electrically ignitable propellant with the pair of electrodes such that electrical power applied to the pair of electrodes flows through the volume of electrically ignitable propellant thus igniting the volume of electrically-ignitable propellant.

Also, the method can comprise, after or during the step of directing the gas to the first portion of the formation, pumping a proppant-containing fluid to the first portion of the formation such that the proppant is introduced into the fractures.

Some embodiments of the method further comprise providing an insulation layer disposed on at least one of the electrodes and operable to combust with the propellant.

In these embodiments, each of the electrodes can have a first edge proximate to the first end of the housing and a second edge proximate to the nozzle. The insulation layer can be disposed so as to extend from the first edge towards the second edge of at least one of the electrodes but not extending to the second edge so that a first portion of the electrically ignitable propellant contacts the second edge of each electrode. When the first portion of electrically ignitable propellant ignites, a flame front is produced and the insulation layer burns away in front of the flame front resulting in contact between the pair of electrodes and a second portion of the electrically ignitable propellant. In some of these embodiments, the downhole tool is continually moved upwards in the wellbore during ignition of the volume of electrically ignitable propellant such that fractures are generated or enhanced in different portions of the formation. In other of these embodiments, after generation or enhancement of fractures in the first portion of the formation, the method includes the following steps:

- ceasing application of electrical power to the pair of electrodes so as to stop the ignition of the volume of electrically ignitable propellant;
- relocating the downhole tool to be proximate to a second portion of the formation;
- applying electrical power to the pair of electrodes after relocation of the downhole tool to thus re-ignite the volume of electrically-ignitable propellant in the detonation section and generate the gas; and directing the gas to the second portion of the formation so as to generate or enhance fractures in the second portion of the formation thus stimulating the production of hydrocarbons from the formation.

In still other of these embodiments, the step of applying electrical power to the electrodes includes rapidly pulsing the electrical power so as to generate electrical pulses having a duration of less than about 0.01 seconds; thus, igniting the volume of electrically-ignitable propellant for less than about 0.01 seconds. Additionally, these embodiments can further comprise determining the pulse duration based on the length of the fracture.

In the above embodiments of the method, the detonation section can comprise a housing having a first end, a second end, and a wall. The wall can have an outer surface and an inner surface. During operation of the downhole tool, the outer surface is exposed to a well annulus between a wellbore wall and the downhole tool. The inner surface defines a central bore extending from the first end to the second end. The central bore contains the propellant and the pair of electrodes.

The above embodiments can further comprise, during ignition of the volume of electrically ignitable propellant, pumping a proppant-containing fluid through the annulus and introducing the proppant-containing fluid to the formation such that the proppant is introduced into the fractures. Alternatively, after or during generation or enhancement of the fractures, the method can further comprise pumping a proppant-containing fluid through the annulus and introducing the proppant-containing fluid to the formation such that the proppant is introduced into the fractures.

While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Additionally, where the term "about" is used in relation to a range it generally means plus or minus half the last significant figure of the range value, unless context indicates another definition of "about" applies.

Also, the terms in the claims have their plain, ordinary meaning unless otherwise explicitly and clearly defined by the patentee. Moreover, the indefinite articles "a" or "an", as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A method of stimulating a hydrocarbon-producing formation comprising:

introducing a downhole tool having a detonation section into a wellbore so that the detonation section is proximate to a first portion of the formation;

applying electrical power to a pair of electrodes;

igniting a volume of electrically-ignitable propellant in the detonation section in response to the application of electrical power to the pair of electrodes, wherein the ignition of the volume of electrically-ignitable propellant generates a gas;

directing the gas to the first portion of the formation so as to generate or enhance fractures in the first portion of the formation thus stimulating the production of hydrocarbons from the formation; and continually moving the downhole tool upwards in the wellbore during which ignition of the volume of electrically-ignitable propellant is pulsed rapidly such that fractures are generated or enhanced in different portions of the formation.

2. The method of claim 1, wherein the downhole tool has a longitudinal axis and the detonation section includes a nozzle which directs the gas in a direction transverse to the longitudinal axis such that the gas interacts with the formation to generate or enhance fractures in the formation.

3. The method of claim 2, further comprising, after or during the step of directing the gas to the first portion of the formation, pumping a proppant-containing fluid to the first portion of the formation such that the proppant is introduced into the fractures.

4. The method of claim 2, further comprising:

contacting the volume of electrically ignitable propellant with the pair of electrodes such that electrical power applied to the pair of electrodes flows through the volume of electrically ignitable propellant thus igniting the volume of electrically-ignitable propellant, and providing an insulation layer disposed on at least one of the electrodes and operable to combust with the propellant, and wherein each of the electrodes has a first edge proximate to the first end of the housing and a second edge proximate to the nozzle and the insulation layer is disposed so as to extend from the first edge towards the second edge of at least one of the electrodes but does not extend to the second edge so that a first portion of the electrically-ignitable propellant contacts the second edge of each electrode, and wherein when the first portion of electrically-ignitable propellant is ignited, a flame front is produced and the insulation layer burns away in front of the flame front resulting in contact between the pair of electrodes and a second portion of the electrically-ignitable propellant.

5. The method of claim 4, wherein the detonation section comprises:

a housing having a first end, a second end, and a wall, the wall having:

an outer surface wherein, during operation of the downhole tool, the outer surface is exposed to a well annulus between a wellbore wall and the downhole tool; and an inner surface defining a central bore extending from the first end to the second end, wherein the central bore contains the propellant and the pair of electrodes.

6. The method of claim 5, further comprising, during ignition of the volume of electrically ignitable propellant, pumping a proppant-containing fluid through the annulus and introducing the proppant-containing fluid to the formation such that the proppant is introduced into the fractures.

7. The method of claim 4, wherein the detonation section comprises:

a housing having a first end, a second end, and a wall, the wall having:

an outer surface wherein, during operation of the downhole tool, the outer surface is exposed to a well annulus between a wellbore wall and the downhole tool; and an inner surface defining a central bore extending from the first end to the second end, wherein the central bore contains the propellant and the pair of electrodes.

8. The method of claim 7, further comprising, after or during generation or enhancement of the fractures, pumping a proppant-containing fluid through the annulus and introducing the proppant-containing fluid to the formation such that the proppant is introduced into the fractures.

9. The method of claim 1, wherein the step of applying electrical power to the electrodes includes rapidly pulsing the electrical power so as to generate electrical pulses having a duration of less than about 0.01 seconds; thus, igniting the volume of electrically-ignitable propellant for less than about 0.01 seconds to produce rapid gas pulses from the gas generated.

10. The method of claim 9, wherein the fractures have a length and further comprising determining the duration based on the length of the fracture.

11. The method of claim 1, further comprising:

contacting the volume of electrically ignitable propellant with the pair of electrodes such that electrical power applied to the pair of electrodes flows through the volume of electrically-ignitable propellant thus igniting the volume of electrically-ignitable propellant, and providing an insulation layer disposed on at least one of the electrodes and operable to combust with the propellant, and wherein each of the electrodes has a first edge proximate to the first end of the housing and a second edge proximate to the nozzle and the insulation layer is disposed so as to extend from the first edge towards the second edge of at least one of the electrodes but does not extend to the second edge so that a first portion of the electrically-ignitable propellant contacts the second edge of each electrode, and wherein when the first portion of electrically-ignitable propellant is ignited, a flame front is produced and the insulation layer burns away in front of the flame front resulting in contact between the pair of electrodes and a second portion of the electrically-ignitable propellant.

12. The method of claim 1, further comprising, after or during the step of directing the gas to the first portion of the formation, pumping a proppant-containing fluid to the first portion of the formation such that the proppant is introduced into the fractures.

13. The method of claim 12, wherein the downhole tool has a longitudinal axis and the detonation section includes a nozzle which directs the gas in a direction transverse to the longitudinal axis such that the gas interacts with the formation to generate or enhance fractures in the formation.

14. The method of claim 12, wherein the step of applying electrical power to the electrodes includes rapidly pulsing the electrical power so as to generate electrical pulses having a duration of less than about 0.01 seconds; thus, igniting the volume of electrically-ignitable propellant for less than about 0.01 seconds to produce rapid gas pulses from the gas generated.

15. The method of claim 14, wherein the fractures have a length and further comprising determining the duration based on the length of the fracture.

16. The method of claim 12, wherein the detonation section comprises:

a housing having a first end, a second end, and a wall, the wall having:

an outer surface wherein, during operation of the downhole tool, the outer surface is exposed to a well annulus between a wellbore wall and the downhole tool; and an inner surface defining a central bore extending from the first end to the second end, wherein the central bore contains the propellant and the pair of electrodes.

17. The method of claim 16, wherein the downhole tool has a longitudinal axis and the detonation section includes a nozzle which directs the gas in a direction transverse to the longitudinal axis such that the gas interacts with the formation to generate or enhance fractures in the formation.

18. The method of claim 17, wherein the step of applying electrical power to the electrodes includes rapidly pulsing the electrical power so as to generate electrical pulses having a duration of less than about 0.01 seconds; thus, igniting the volume of electrically-ignitable propellant for less than about 0.01 seconds to produce rapid gas pulses from the gas generated.

19. The method of claim 18, wherein the fractures have a length and further comprising determining the duration based on the length of the fracture.

20. The method of claim 19, further comprising:

contacting the volume of electrically ignitable propellant with the pair of electrodes such that electrical power applied to the pair of electrodes flows through the volume of electrically-ignitable propellant thus igniting the volume of electrically-ignitable propellant, and providing an insulation layer disposed on at least one of the electrodes and operable to combust with the propellant, and wherein each of the electrodes has a first edge proximate to the first end of the housing and a second edge proximate to the nozzle and the insulation layer is disposed so as to extend from the first edge towards the second edge of at least one of the electrodes but does not extend to the second edge so that a first portion of the electrically-ignitable propellant contacts the second edge of each electrode, and wherein when the first portion of electrically-ignitable propellant is ignited, a flame front is produced and the insulation layer burns away in front of the flame front resulting in contact between the pair of electrodes and a second portion of the electrically-ignitable propellant.

* * * * *